US005911189A

United States Patent [19]

Ryan

[11] Patent Number: 5,911,189

[45] Date of Patent: Jun. 15, 1999

[54] BOAT GUIDE FOR USE IN GUIDING A BOAT INTO OR OUT OF A BOAT SLIP

[76] Inventor: John Michael Ryan, P.O. Box 238, Ketchum, Okla. 74349

[21] Appl. No.: 09/109,629

[22] Filed: Jul. 2, 1998

[51] Int. Cl.[6] ..... B63B 21/00

[52] U.S. Cl. ..... 114/230; 114/220

[58] Field of Search ..... 114/263, 230, 114/219, 220, 44, 45

[56] References Cited

U.S. PATENT DOCUMENTS

| | | | |
|---|---|---|---|
| 799,645 | 9/1905 | Grimm | 114/220 |
| 2,652,694 | 9/1953 | Melges | 405/213 |
| 2,754,792 | 7/1956 | Baird | 114/230 |
| 3,084,517 | 4/1963 | Bell | 61/48 |
| 3,145,685 | 8/1964 | Kulick, Sr. | 114/220 |
| 3,151,595 | 10/1964 | Stainbrook | 114/230 |
| 3,177,839 | 4/1965 | Nolf | 114/230 |
| 3,336,896 | 8/1967 | Burnett | 115/7 |
| 4,679,517 | 7/1987 | Kramer | 114/45 |
| 4,804,296 | 2/1989 | Smith | 405/212 |
| 4,920,907 | 5/1990 | Richter | 114/219 |
| 5,113,702 | 5/1992 | Capps | 114/219 |

*Primary Examiner*—Ed L. Swinehart
*Attorney, Agent, or Firm*—Head Johnson & Kachigian

[57] ABSTRACT

A boat guide for use in guiding a boat into or out of a boat slip has an elongated upright tubular member with upper and lower end caps, each end cap having a central opening therethrough. An axle is received coaxially within the tubular member and extends through the openings in the end caps, the axle being of external diameter less than the interior diameter of the tubular member providing an annular space between the axle and the tubular member so that the tubular member can deflect relative to the axle to absorb the shock of a boat impact. An upper attachment above the upper end cap and a lower attachment below the lower end cap provide vertical support for the axle, the tubular member and end caps being rotatable relative to the upper and lower attachments.

21 Claims, 4 Drawing Sheets

BOAT GUIDE FOR USE IN GUIDING A BOAT INTO OR OUT OF A BOAT SLIP

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

Recreation boats are frequently kept in boat stalls, sometimes called boat slips. This is true on fresh water lakes and many smaller boats used on salt water are also housed in boat stalls, particularly boats that are kept in mooring areas in bays, estuaries and inlets along sea coasts. A typical boat dock consisted of a structure having one or many open stalls or slips, each with parallel sidewalls. The slips each have an open end into which the boat enters and from which the boat exits. Walkways are frequently provided around the slip sidewalls.

People who have never operated a boat have little conception of the difficulty of docking a boat under windy or rough water conditions and particularly under a combination of wind and rough water. Steering a boat, particularly at low speeds is difficult since changing the direction of travel of the front of a boat is done indirectly, that is, by changing the relative orientation of the rearward end of the boat, as contrasted with a wheeled vehicle in which steering takes place at the front. With a boat it is very difficult to make immediate changes in the direction of travel and this problem is aggravated by winds, currents or waves or a combination of these three. In any event, docking a boat is difficult and when a boat contacts a dock structure the possibility of damage is significant. Accordingly, a need exists for improved boat dock guides.

For background information relating to facilities for improving boat docks and particularly for guiding boats into and out of a boat dock or for reducing the possibility of damage of a boat while stored in a boat dock, reference can be had to the following previously issued United States patents.

| U.S. Pat. No. | INVENTOR | TITLE |
|---|---|---|
| 5133702 | Capps | Boat and Dock Guard |
| 2754792 | Baird | Mooring Device For Boats |
| 3084517 | Bell | Dock Attachment |
| 3151595 | Stainbrook | Mooring Line Retaining Device |
| 3177839 | Nolf | Boat-Docking Apparatus With Pressure-Responsive Grapple |
| 3336896 | Burnett | Ship Docking Device |
| 4679517 | Kramer | Fender Protecting Structures |
| 4920907 | Richter | Boat Dock Bumper |

BRIEF SUMMARY OF THE INVENTION

This disclosure provides a greatly improved boat dock guide for use in guiding a boat into and out of a boat slip. Boat slips typically include vertically oriented rollers positioned at each opposite corner of the entry. Frequently boat stalls also include vertical rollers to engage the front of a boat after it has been positioned within a boat stall. Usually the most important guides are those that are at the opposite corners of the entry into the boat slip.

The boat guide of this disclosure includes an elongated upright tubular plastic member that is preferably made of a tough yet flexible material. In a preferred embodiment the elongated upright tubular member is made of polyurethane.

A first end cap is secured on the tubular member upper end and a second end cap is secured to the tubular member lower end. The end caps may be made of polyethylene and can be in the form of end caps commonly employed with polyethylene or other types of plastic pipes utilized to convey liquids or gases. Each of the end caps has a central opening in it.

An axle is positioned coaxially within the tubular member and extends through the openings in each of the end caps. The axial is preferably a metal rod that has an external diameter substantially less than the interior diameter of the tubular member to provide an annular space between the exterior of the axle and the interior of the tubular surface of the tubular member. A support bracket, preferably made of metal, is attached to the boat dock. The support bracket has an upper attachment point to which the axle is secured above the upper end cap and a lower attachment point to which the axle is attached below the second or lower end cap. The tubular member, with attached end caps, is rotatable relative to the axle and to the support bracket. The support bracket is preferably of sufficient length to extend from adjacent or below the surface of the water in which the boat dock is positioned to well above the gunnels of the boat to be received in the boat dock. Thus, the boat guide is relatively long compared to its diameter. In the preferred arrangement the tubular member is of a diameter of about 2 inches to about 6 inches. Further, the tubular member is preferably made out of a tough yet flexible plastic material, such as polyurethane.

A boat guide constructed of a polyurethane tubular member substantially reduces the possibility of damage to a boat since it will flex relative to the axle that supports its. In the preferred arrangement the boat guide is not only capable of deflection but rotation so that when the gunnels of a boat contact the boat guide it is free to rotate rather than to scrape on the boat gunnels and, at the same time, to absorb a blow from the gunnels by deflection without damaging the guide, the axle or the support bracket.

A better understanding of the invention will be obtained from the following description of the preferred embodiments and claims, taken in conjunction with the attached drawings.

DESCRIPTION OF THE DRAWINGS

FIG. 8 shows an intermediate lateral support that limits the deflection of the boat guide.

FIGS. 9, 10 and 11 show the intermediate lateral support of and within itself without attachment to a bracket with the understanding that the intermediate support of FIGS. 9 through 11 would be welded or otherwise attached to a bracket such as the bracket shown in FIGS. 2, 3 and 4 or a bracket as illustrated in FIGS. 5, 6 and 7.

DETAILED DESCRIPTION OF THE PREFERRED EMBODIMENTS

Figure 1:
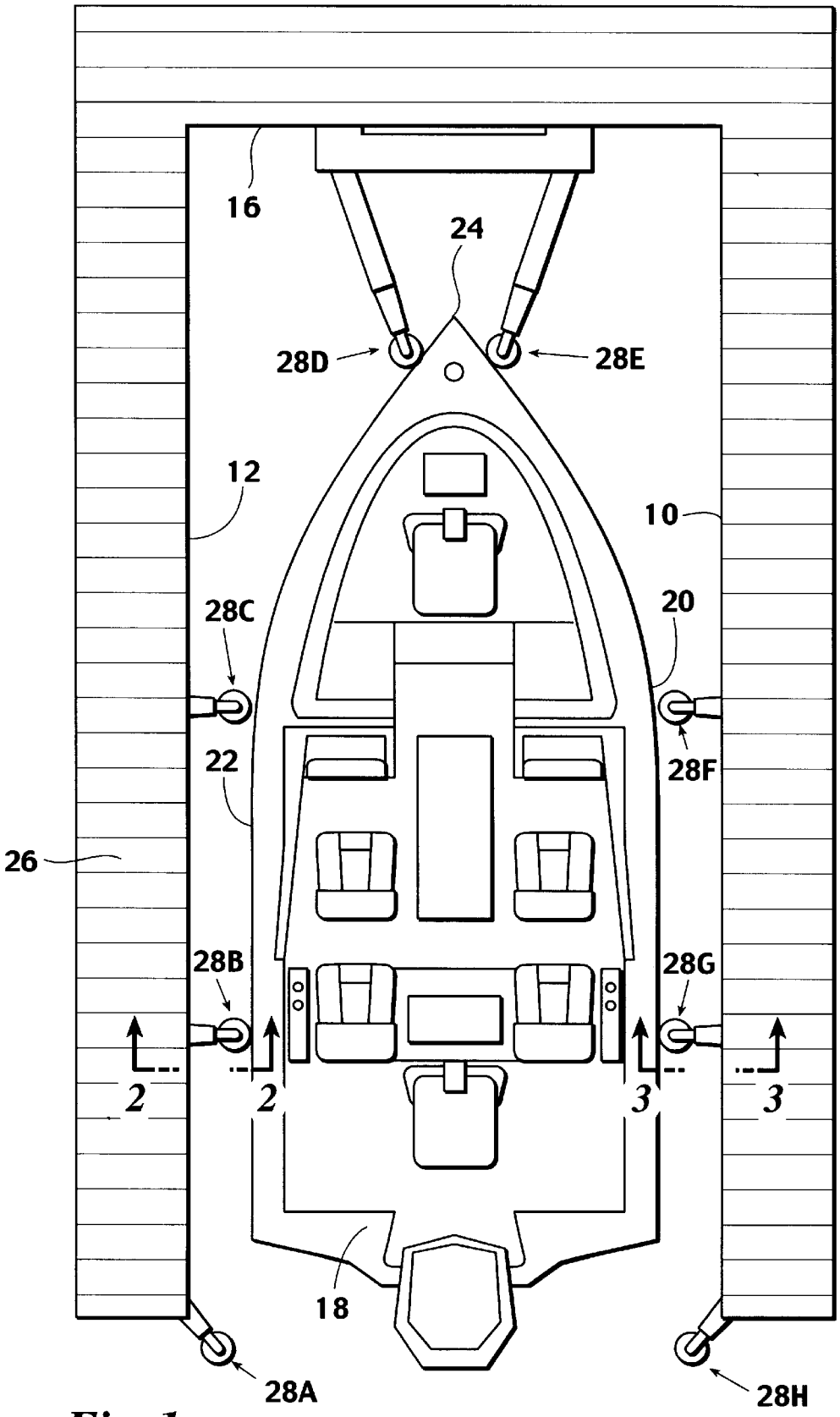
FIG. 1 is a plan view of a typical boat dock having a slip therein and showing a boat positioned within the slip. Further, this figure shows a plurality of boat guides of the type of the present invention, the boat guides functioning to improve the convenience of piloting a boat into the boat slip and for backing the boat out of the boat slip while reducing the possibility of damage to the boat.

Referring to the drawings and first to FIG. 1, a plan view of a typical boat dock is shown. The boat dock includes a boat slip defined by a right side wall 10, a left side wall 12 and a front sidewall 16 with the entry into the boat slip being opened. Positioned within the slip is a boat 18 in which the starboard side 20 is adjacent the slip right side wall 10; the boat port side 22 is adjacent the slip side wall 12 and the bow 24 is in the direction towards the slip front side wall 16.

Figure 10:
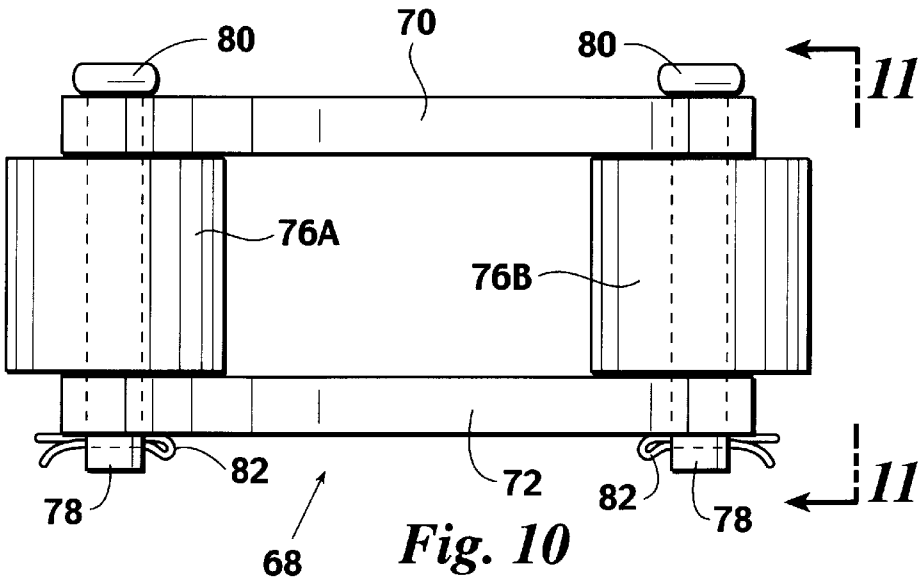
FIG. 10 is a front elevational view of the intermediate support taken along the line 9—9 of FIG. 9.

The boat slip as shown in FIG. 10 has a typical walkway 26 that extends around three sides of the slip for convenience of passengers entering and exiting the boat.

The purpose of this invention is to provide an improved guide for assisting the operator of boat 18 when entering or exiting from the boat slip. FIG. 1 illustrates the placement of eight guides indicated by the numerals 28A through 28H. This is merely a typical arrangement and is not indicated to be an element of the present invention as a boat slip can be arranged with as few or as many of the boat guides as is required according to the shape of the slip and the size and nature of the boat that the slip is to receive. Further, when a boat slip is located in water that is normally calm and in an area with relatively little wind, fewer boat guides would be required whereas a boat slip located where water is frequently rough, that is, having high waves and wherein there may frequently be winds or currents then a greater number of boat guides are usually required. The invention is concerned not with the configuration of the boat slip or boat dock of FIG. 1 which is illustrated for background but in the arrangements of an improved boat guide which will now be described with reference to FIGS. 2 through 11.

Figure 2:
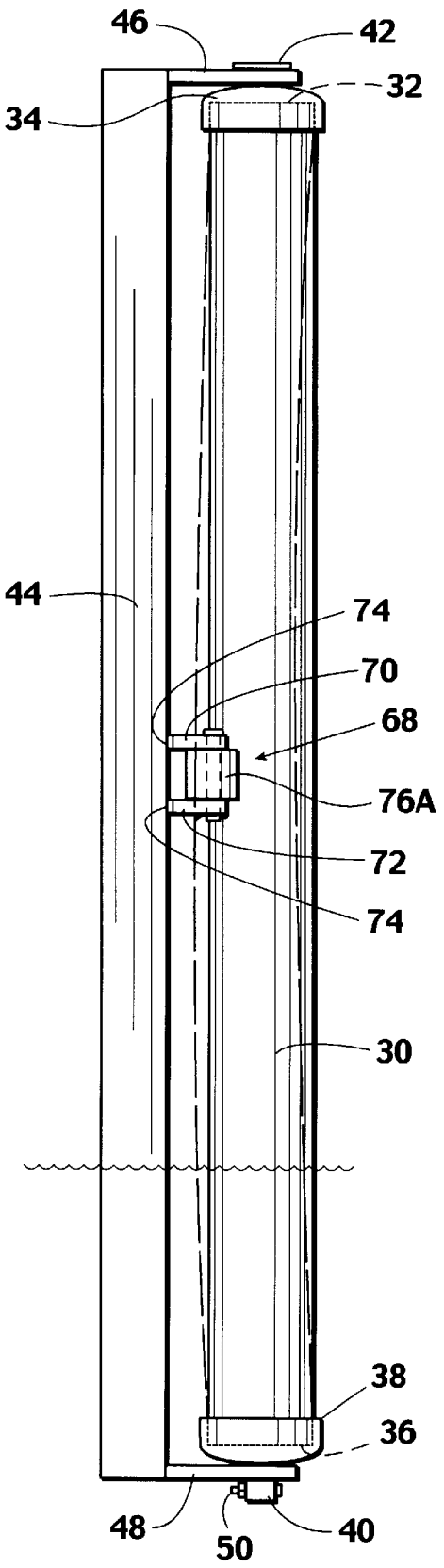
FIG. 2 is an elevational cross-sectional view taken along the line 2—2 of FIG. 1 showing a boat guide that employs the principal of this invention.
Figure 3:
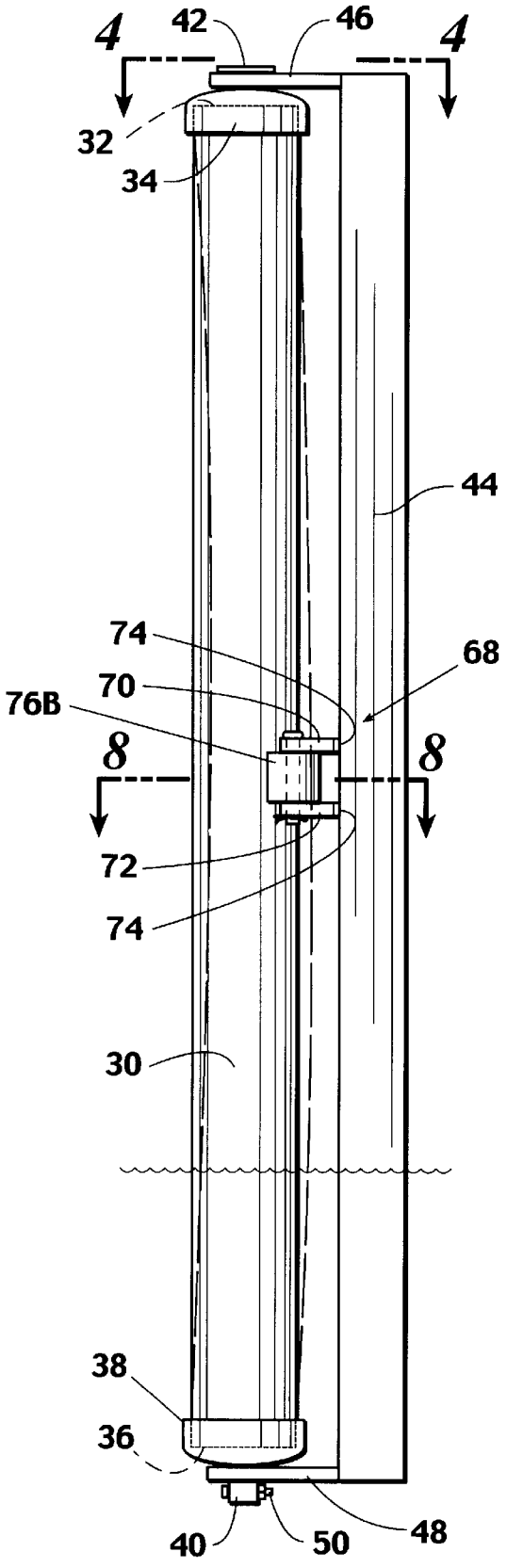
FIG. 3 is an elevational view of a boat guide as taken along the line 3—3 of FIG. 1. The boat guide of FIGS. 2 and 3 each has an intermediate bracket to eliminate the maximum deflection of the boat guide tubular member upon impact by a boat.

FIGS. 2 and 3 show elevational views of a boat guide that is useful in practicing the invention. The boat guide includes, as a basic element, an upright vertical tubular member 30 (see particular FIGS. 2, 3 and 8). Tubular member 30 is made of plastic and in a preferred practice of the invention is made of polyurethane. This material is available commercially from Phillips Petroleum Company and is sold under the trademark "DRISCOPIPE", a registered trademark of Phillips Petroleum Company. The use of polyurethane tubular member achieves many improvements over known types of plastic pipe because of its extreme toughness and yet flexibility.

As shown in FIGS. 2 and 3, there is attached to the upper end 32 of tubular member 30 a first, or upper end cap 34 and attached to the tubular member lower end 36 a second, or lower end cap 38. End caps 34 and 38 are commercially available as commonly used in the plumbing and piping industry for capping off or terminating a length of plastic pipe. End caps 34 and 38 may be, by example, formed of PVC pipe which is a type of pipe frequently employed for transmitting water and other liquids or gases that do not have exceedingly high pressures. Each of the end caps 34 and 38 has an axial opening therethrough (not seen in the drawing).

Figure 8:
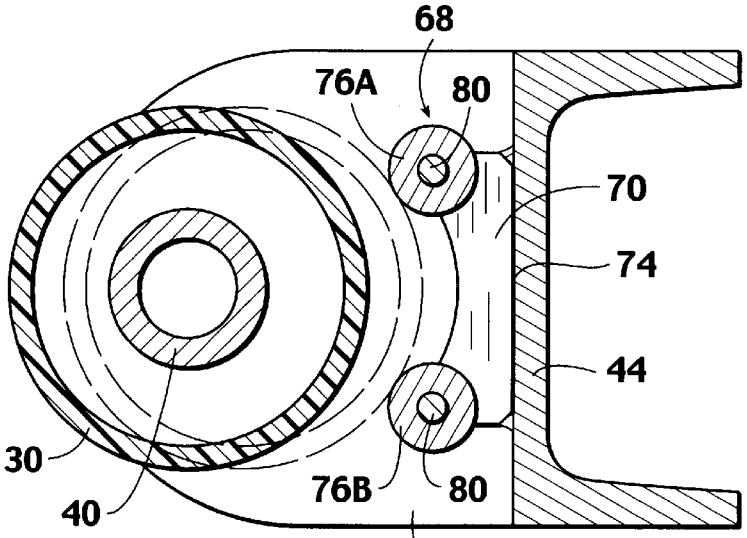
FIG. 8 is a cross-sectional view taken of FIG. 3 showing the boat guide in cross-section and supported by an elongated vertical in-line channel member and further.

Axially received within tubular member 30 and extending through the openings in upper and lower end caps 34 and 38 is an axle 40 seen in cross-section in FIG. 8. A lower end portion of axle 40 is seen in FIGS. 2 and 3. Axle 40 is shown in FIG. 8 as being a pipe that is tubular in cross-section however the axle 40 can be a solid rod. The axle 40 is preferably made of steel and has a enlarged external diameter head 42 at an upper end as seen in FIGS. 2 and 3 to keep the axle in position to support the tubular member.

Figure 4:
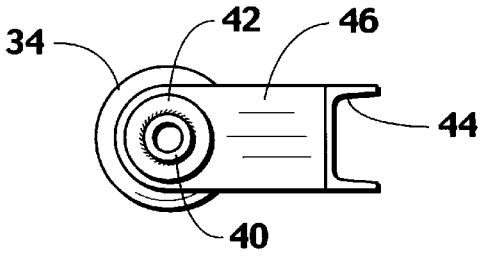
FIG. 4 is a top plan view of the boat guide of FIG. 3 taken along the line 4—4 of FIG. 3.

Tubular member 30 must be vertically supported and this is accomplished by means of a bracket. In the embodiment of FIGS. 2, 3 and 4 the bracket is in the form of an elongated structural steel channel 44 that is adaptable to attachment to the side wall of a boat dock, such as to the side walls 10 and 12 of the boat dock of FIG. 1. Bracket 40 has at an upper end thereof a horizontal arm 46 and at the lower end thereof a horizontal arm 48. The horizontal arms 46 and 48 are of metal, preferably steel and each has a vertical opening therethrough (not seen) that receives axle 40. As shown in FIG. 2 the axle enlarged diameter head 42 engages the upper surface of upper horizontal arm 46. Below the lower horizontal arm 48, a pin 50 extends through axle 40 to retain the axle in position. As illustrated in FIGS. 2 and 3, pin 50 is in the form of a small bolt having a bolt head and a nut so that the pin is held in place to prevent axle 40 from being inadvertently withdrawn from the bracket arms.

Figure 7:
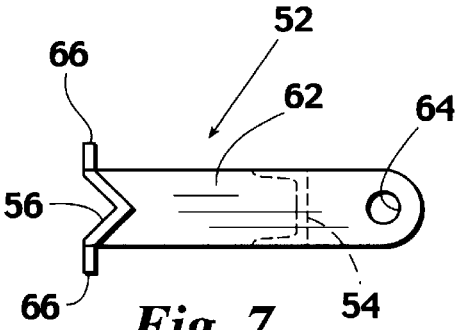
FIG. 7 is a top plan view of the bracket, taken along the line 7—7 of FIG. 5.
Figure 5:
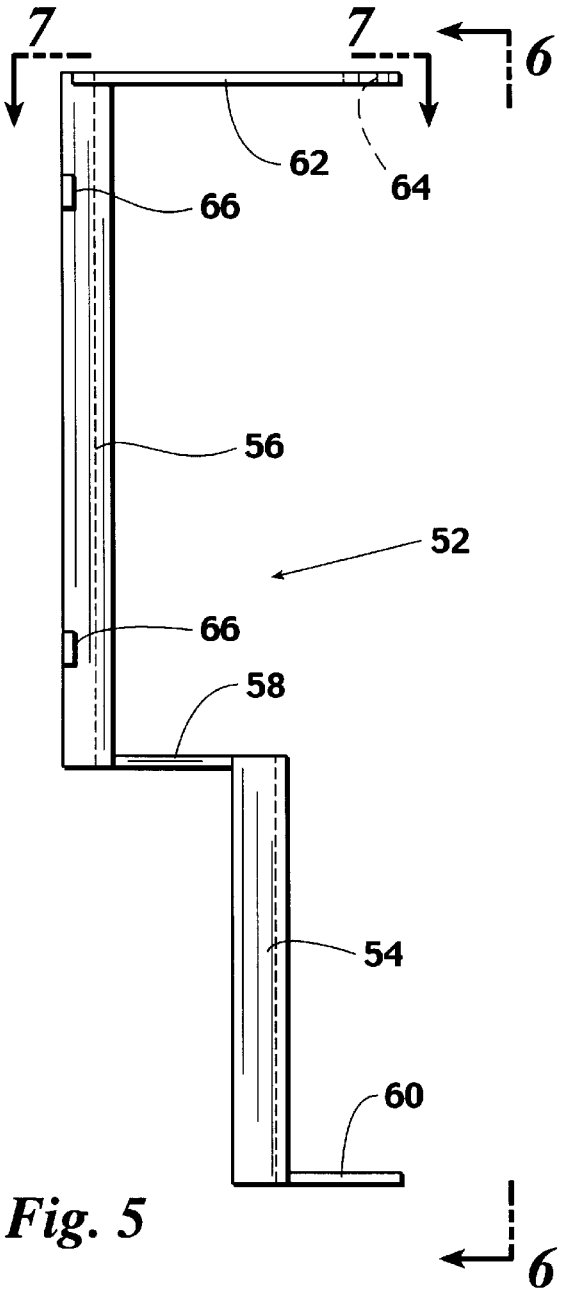
FIG. 5 is an elevational view of one embodiment of a bracket for use in supporting a boat guide that is particularly adaptable for use in a boat dock wherein the boat slip has a walkway which can be employed to support the bracket.
Figure 6:
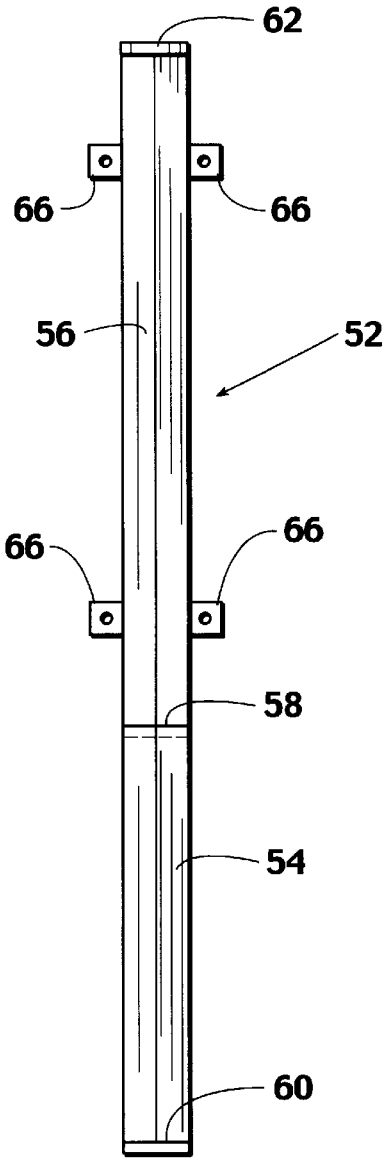
FIG. 6 is an elevational view of the bracket, taken along the line 6—6 of FIG. 5.

FIGS. 5, 6 and 7 show an alternate design of a bracket that is particularly applicable for a boat dock of the type illustrated in FIG. 1 that has a walkway 26 around the slip. The bracket, generally indicated by the numeral 52 in FIGS. 5, 6 and 7, includes a vertical lower portion 54 and an offset vertical upper portion 56, the portions being joined together by an intermediate flat bar 58.

Secured to the lower end of the bracket lower portion 54 is a horizontal lower arm 60 that is equivalent to the arm 48 in the embodiments of FIGS. 2 and 3. A longer upper arm 62 is secured to the upper end of the bracket upper portion 56. Each of arms 60 and 62 has an opening in the outer end, opening 64 being seen in FIG. 7.

The offset arms shown in FIGS. 5, 6 and 7 is illustrated with the lower portion 54 being formed of a channel member 54 as seen in dotted outline in FIG. 7 whereas the upper portion 56 is of an L-shaped configuration as seen in solid outline in FIG. 7. The cross-sectional arrangement of bracket portions 54 and 56 is not critical to the invention as these portions can be constructed of structural steel of various cross-sections depending upon the arrangement of the boat dock for which they are used. To provide a means to attach bracket upper portion 56 to a vertical post (not seen) forming a part of a boat dock, outwardly extending tabs 66, each having an opening therein are welded to the L-shaped bracket upper portion. (See FIGS. 5, 6 and 7)

Bracket 52 is employed in the same way as bracket 44, that is, an axle is received within the openings in arms 60 and 62 to support a tubular member in the same way as the tubular member 30 is supported in the embodiments of FIGS. 2 and 3.

Figure 11:
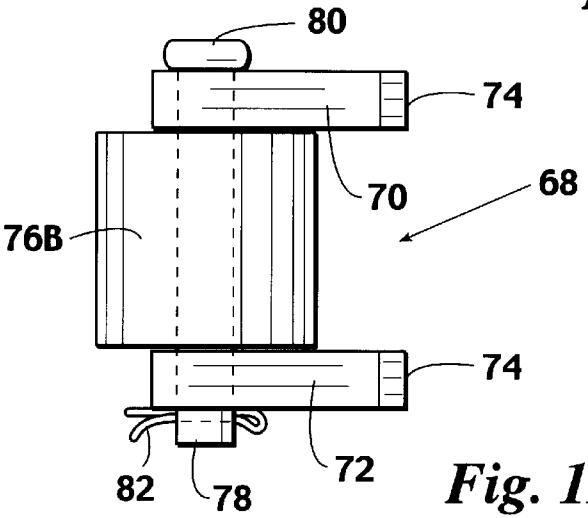
FIG. 11 is a side elevational view of the intermediate lateral support taken along the line 11—11 of FIG. 10.
Figure 9:
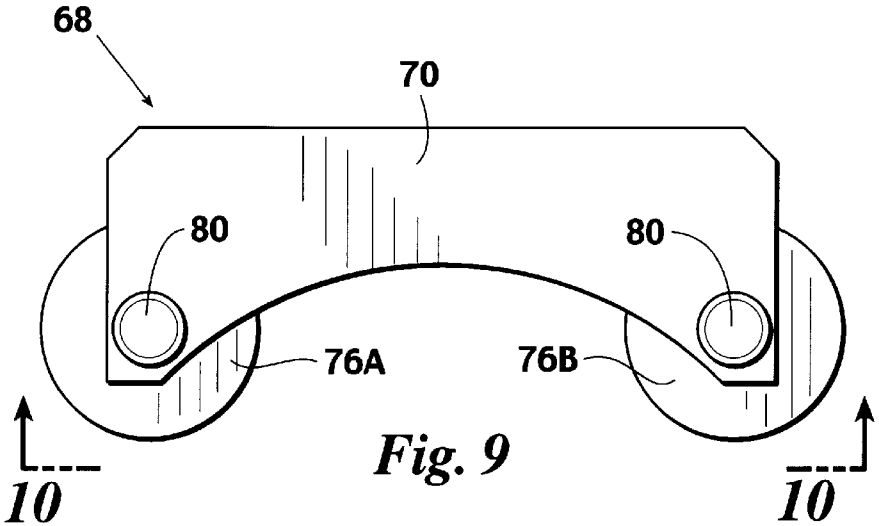
FIG. 9 is an enlarged plan view of the intermediate lateral support shown in FIG. 8.

In order to safely guide a boat into and out of a boat dock slip it is important that the gunnels of the boat contact the boat guide even in the roughest water where the elevation of the boat can shift up or down several feet. For this reason, the boat guide as described herein needs to be relatively long and typically may be from a length of 4 feet for a smaller boat to as long as 6 or 7 feet for a large boat. To provide resiliency to absorb shock, the tubular member 30 is specifically configured to deflect relative to its support axle upon receiving impact of a boat. However, the degree of deflection needs to be controlled and, for this purpose, intermediate lateral supports generally indicated by the numeral 68 are employed, the lateral supports being illustrated as used in the embodiment of the invention in FIGS. 2 and 3 and details of the intermediate lateral supports are shown in FIGS. 9, 10 and 11. Each of the lateral supports 68 includes a horizontal upper plate 70 and a matching horizontal lower plate 72. Each of the plates has a rearward edge 74 that is welded to a vertical bracket. In the embodiments of FIGS. 2 and 3 the rearward edges 74 are welded to brackets 44.

Rotatably supported between upper and lower plates 70 and 72 are a pair of rollers 76A and 76B. Rollers 76A and 76B are preferably made of plastic, such as polyvinylchloride and each has a vertical opening receiving a pin 78. Each of the pins has a head 80 at one end and an opening therethrough at the lower end to receive a cotter key 82 so that the pins are retained in position and rollers 76A and 76B are free to rotate.

As shown in FIG. 8, when tubular member 30 is in its normal non-deflected position, that is, in the position it takes at all times except when contacted by a boat, the external surface of the tubular member does not engage rollers 76A and 76B. However, as shown in dotted outline in FIG. 8, when the tubular member is deflected a substantial amount the exterior surface thereof contacts rollers 76A and 76B to limit the tubular member deflection.

The provision of intermediate lateral supports 68 helps prevent bending of axle 40 while, at the same time, permitting substantial shock absorption by deflection of tubular member 30 when receiving the impact of a boat.

The particular structural arrangement of the boat guide as described herein is intended to be by example and not by limitation. It can be seen that the configuration of bracket 44 can be changed considerably dependent upon the structure to which the boat guide is to be attached. The specific structural steel components utilized to manufacturer the brackets that are used to support tubular members 30 can vary considerably while still attaining the principals of the invention. Further, the specific design of the intermediate lateral support 68 can vary while still functioning to limit the deflection of tubular member 30. The essence of the invention is the provision of an elongated vertical tubular member formed of tough yet flexible plastic that is free to deflect relative to a central axle to absorb the shock of contact by a boat as the boat guide is used for guiding a boat into or out of a boat slip.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A boat guide for use in guiding a boat into or out of a boat slip comprising:

an elongated upright tubular member in the form of plastic pipe of diameter of about 2 inches to about 6 inches and having an upper end and a lower end;

a first end cap secured on said tubular member upper end;

a second end cap secured on said tubular member lower end, each end cap having a central opening therethrough;

an axle received coaxially within said tubular member and extending through said opening in each of said end caps, said axle being of external diameter less than all interior diameters of said tubular member providing an annular space between said axle and said tubular member; and an upper attachment point above said first end cap and a lower attachment point below said second end cap providing vertical support for said axle, said tubular member and end caps being rotatable relative to said upper and lower attachment points.

2. A boat guide according to claim 1 wherein said axle is a metal rod and wherein said tubular member and said end caps are rotatable relative to said axle.

3. A boat guide according to claim 1 wherein said tubular member is formed of a length of polyurethane pipe of diameter of about 2 inches to about 6 inches.

4. A boat guide according to claim 1 wherein said plastic pipe has a wall thickness of about 3/16 inches to about 7/16 inches.

5. A boat guide according to claim 3 wherein said polyurethane pipe has a wall thickness of about 3/16 inches to 7/16 inches.

6. A boat guide according to claim 1 including;

an elongated upright bracket attachable to a boat dock in the form of a vertical metal structural body having an upper end and a lower end; and an upper horizontally extending arm affixed to said structural body upper end and a lower horizontally extending arm affixed to said structural body lower end, said upper end of said axle being supported by said upper arm and said lower end of said axle being supported by said lower arm, said axle being thereby supported at least substantially parallel to and spaced from said bracket, said arm providing said upper and lower attachment points.

7. A boat guide according to claim 6 wherein said upper and lower arms each have a vertical opening therethrough receiving said axle and an upper retainer affixed to said axle above said upper arm and a lower retainer affixed to said axle above said lower arm.

8. A boat guide according to claim 6 wherein said bracket has a first lower portion having said bracket lower end and having said lower arm extending therefrom and having a second upper portion having said bracket upper end having said upper arm extending therefrom, the bracket second upper portion being spaced a greater distance from said axle than said bracket first lower portion and a third horizontal bracket portion interconnecting said first lower and second upper bracket portions.

9. A boat guide according to claim 6 including an intermediate lateral support affixed to said bracket intermediate said upper and lower ends thereof, the intermediate support being exterior of said tubular member and positioned between said tubular member and said bracket and spaced to limit inward deflection of said tubular member toward said bracket.

10. A boat guide according to claim 8 including an intermediate lateral support affixed to said bracket second upper portion intermediate said horizontal bracket portion and said bracket upper end, the intermediate support being exterior of said tubular member and positioned between said tubular member and said bracket and spaced to limit inward deflection of said tubular member toward said bracket.

11. A boat guide according to claim 9 wherein said intermediate support has a pair of spaced apart vertical pins each rotatably supporting a roller thereon, the rollers being spaced so that peripheral surfaces thereof are less in distance apart than an external diameter of said tubular member.

12. A boat guide for use in guiding a boat into or out of a boat slip comprising:

an elongated upright tubular member having an upper end and a lower end;

a first end cap secured on said tubular member upper end;

a second end cap secured on said tubular member lower end, each end cap having a central opening therethrough;

an axle received coaxially within said tubular member and extending through said opening in each of said end caps, said axle being of external diameter less than all interior diameters of said tubular member providing an annular space between said axle and said tubular member;

an upper attachment point above said first end cap and a lower attachment point below said second end cap providing vertical support for said axle, said tubular member and end caps being rotatable relative to said upper and lower attachment points;

an elongated upright bracket attachable to a boat dock in the form of a vertical metal structural body having an upper end and a lower end;

an upper horizontally extending arm affixed to said structural body upper end and a lower horizontally extending arm affixed to said structural body lower end, said upper end of said axle being supported by said upper arm and said lower end of said axle being supported by said lower arm said axle being thereby supported at least substantially parallel to and spaced from said bracket, said arm providing said upper and lower attachment points; and an intermediate lateral support affixed to said bracket intermediate said upper and lower ends thereof, the intermediate support being exterior of said tubular member and positioned between said tubular member and said bracket and spaced to limit inward deflection of said tubular member toward said bracket.

13. A boat guide according to claim 12 wherein said axle is a metal rod and wherein said tubular member and said end caps are rotatable relative to said axle.

14. A boat guide according to claim 12 wherein said tubular member is formed of a length of plastic pipe of diameter of about 2 inches to about 6 inches.

15. A boat guide according to claim 12 wherein said tubular member is formed of a length of polyurethane pipe of diameter of about 2 inches to about 6 inches.

16. A boat guide according to claim 14 wherein said plastic pipe has a wall thickness of about 3/16 inches to about 7/16 inches.

17. A boat guide according to claim 15 wherein said polyurethane pipe has a wall thickness of about 3/16 inches to 7/16 inches.

18. A boat guide according to claim 12 wherein said upper and lower arms each have a vertical opening therethrough receiving said axle and an upper retainer affixed to said axle above said upper arm and a lower retainer affixed to said axle above said lower arm.

19. A boat guide according to claim 12 wherein said bracket has a first lower portion having said bracket lower end and having said lower arm extending therefrom and having a second, upper portion having said bracket upper end having said upper arm extending therefrom, the bracket second upper portion being spaced a greater distance from said axle than said bracket first lower portion and a third horizontal bracket portion interconnecting said first lower and second upper bracket portions.

20. A boat guide according to claim 19 including an intermediate lateral support affixed to said bracket second upper portion intermediate said horizontal bracket portion and said bracket upper end, the intermediate support being exterior of said tubular member and positioned between said tubular member and said bracket and spaced to limit inward deflection of said tubular member toward said bracket.

21. A boat guide according to claim 12 wherein said intermediate support has a pair of spaced apart vertical pins each rotatably supporting a roller thereon, the rollers being spaced so that peripheral surfaces thereof are less in distance apart than an external diameter of said tubular member.

* * * * *